US009751021B2

(12) United States Patent
Schwartz

(10) Patent No.: US 9,751,021 B2
(45) Date of Patent: Sep. 5, 2017

(54) WATER RIDE FLOTATION DEVICE DISPENSER

(71) Applicant: Universal City Studios LLC, Universal City, CA (US)

(72) Inventor: Justin Michael Schwartz, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 14/920,654

(22) Filed: Oct. 22, 2015

(65) Prior Publication Data

US 2017/0113149 A1 Apr. 27, 2017

(51) Int. Cl.

*A63G 3/00* (2006.01)
*A63G 4/00* (2006.01)
*A63G 31/00* (2006.01)

(52) U.S. Cl.

CPC ..... *A63G 4/00* (2013.01); *A63G 3/00* (2013.01); *A63G 31/007* (2013.01)

(58) Field of Classification Search

CPC ..... A63G 31/00; A63G 31/007; A63G 3/00; A63G 3/02; G07F 11/00; G07F 11/44; G07F 11/54; G07F 11/62; B65H 2220/00; B65H 2220/03; B63C 9/22; B63C 9/23

USPC ..... 472/117, 128, 129; 221/92, 102, 104; 441/88

See application file for complete search history.

(56) References Cited

U.S. PATENT DOCUMENTS 2,406,250 A * 8/1946 Petouhoff ..... B63C 9/22 114/367
2,585,872 A 2/1952 Steiner
2,805,430 A * 9/1957 Philbrick ..... B63C 9/22 114/363
3,168,964 A 2/1965 Davis
3,436,525 A 4/1969 Stanford
3,642,170 A 2/1972 Shelley
4,171,753 A 10/1979 Vreede
5,453,054 A * 9/1995 Langford ..... A63G 21/18 405/79
5,820,471 A * 10/1998 Briggs ..... A63B 9/00 472/117
5,853,332 A * 12/1998 Briggs ..... A63B 9/00 472/128
7,128,997 B2 * 10/2006 Harding ..... H01M 8/04201 206/503

FOREIGN PATENT DOCUMENTS

FR 2872013 12/2005

OTHER PUBLICATIONS

PCT/US2016/057545 Invitation to Pay Additional Fees dated Feb. 10, 2017.

* cited by examiner

*Primary Examiner* — Kien Nguyen
(74) *Attorney, Agent, or Firm* — Fletcher Yoder, P.C.

(57) ABSTRACT

A dispenser for a flotation device in accordance with present embodiments may include a housing comprising an aperture. The dispenser may also include a plurality of flotation devices positioned in the housing; and a base positioned in the housing and supporting the plurality of flotation devices, wherein the base is configured to move relative to the housing to move the plurality of flotation devices jointly to position at least one flotation device adjacent to the aperture to permit removal of the at least one flotation device from the housing via the aperture.

22 Claims, 10 Drawing Sheets

WATER RIDE FLOTATION DEVICE DISPENSER

BACKGROUND

The present disclosure relates generally to the field of amusement parks. More specifically, embodiments of the present disclosure relate to methods and equipment utilized to provide water park experiences.

Water parks seek to provide a variety of ride experiences for park visitors, including bumper or raft rides, water slides, log rides, water coasters, and lazy rivers. Lazy rivers, for example, provide a water route on which park visitors can relax and float along the river in an inner tube or other flotation device. Often these inner tubes are stacked by the entrance to the river and/or are found floating along the river at various entry points, and a guest waiting to enter the lazy river may either wait for an unused tube to float to an entrance, which is inconvenient and may result in entry bottlenecks, or may dig through a disorganized pile of tubes at the entrance of the lazy river. Further, inner tubes stacked by the entrance tend to scatter, which results in the entrance being messy and visually unappealing to guests.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a dispenser for a flotation device is provided that includes a housing comprising an aperture; a plurality of flotation devices positioned in the housing; and a base positioned in the housing and supporting the plurality of flotation devices, wherein the base is configured to move relative to the housing to move the plurality of flotation devices jointly to position at least one flotation device adjacent to the aperture to permit removal of the at least one flotation device from the housing via the aperture.

In another embodiment, a water park attraction is provided that includes a water circuit. The water park attraction also includes an inner tube dispenser for inner tubes configured to be used in the water circuit, wherein the inner tube dispenser comprises: a housing comprising an aperture; a plurality of inner tubes; and a moveable portion coupled to the housing and supporting the plurality of inner tubes, wherein the movable portion is configured to move relative to the housing to move the plurality of inner tubes to position at least one inner tube adjacent to the aperture to permit removal of the at least one inner tube from the housing via the aperture.

In another embodiment, a method is provided that includes the steps of loading a plurality of flotation devices into a dispenser to position a base of the dispenser in a fully loaded configuration and to position a first flotation device of the plurality of the flotation devices adjacent to an aperture; ejecting at least a portion of the first flotation device from the dispenser through the aperture to permit the base to move and position a second flotation device adjacent to the aperture; and removing the second flotation device from the dispenser through the aperture.

In another embodiment, a water park attraction is provided that includes a water circuit having a flow direction; and an inner tube dispenser for inner tubes configured to be used in the water circuit. The inner tube dispenser includes a containment area comprising an entry aperture and an exit aperture; a plurality of inner tubes; and a plurality of flow ports within the containment area configured to create additional movement of the inner tubes towards the exit aperture, wherein the entry aperture is larger than the exit aperture, and wherein the exit aperture is smaller than at least dimension of the one of the plurality of inner tubes.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure relates to dispensers for flotation devices for water park attractions. Provided herein are dispensers that permit orderly containment and distribution of water ride flotation devices, such as inner tubes. In certain embodiments, the dispensers may be manually operated by a water ride passenger, who may remove a flotation device via an aperture in the dispenser. When the flotation device is removed from the dispenser, a new flotation device is subsequently moved into position to be distributed to the next passenger. The dispensers may be positioned adjacent to various entry points to the water ride to permit passengers to obtain flotation devices at the ride points of entry. In addition, in certain embodiments, the dispensers act as collection points for flotation devices after the passengers have exited the ride. While the depicted embodiments are disclosed in the context of a lazy river and inner tube flotation devices, it should be understood that the dispensers of the present disclosure may be used in conjunction with other types of water rides and/or flotation devices.

Figure 1:
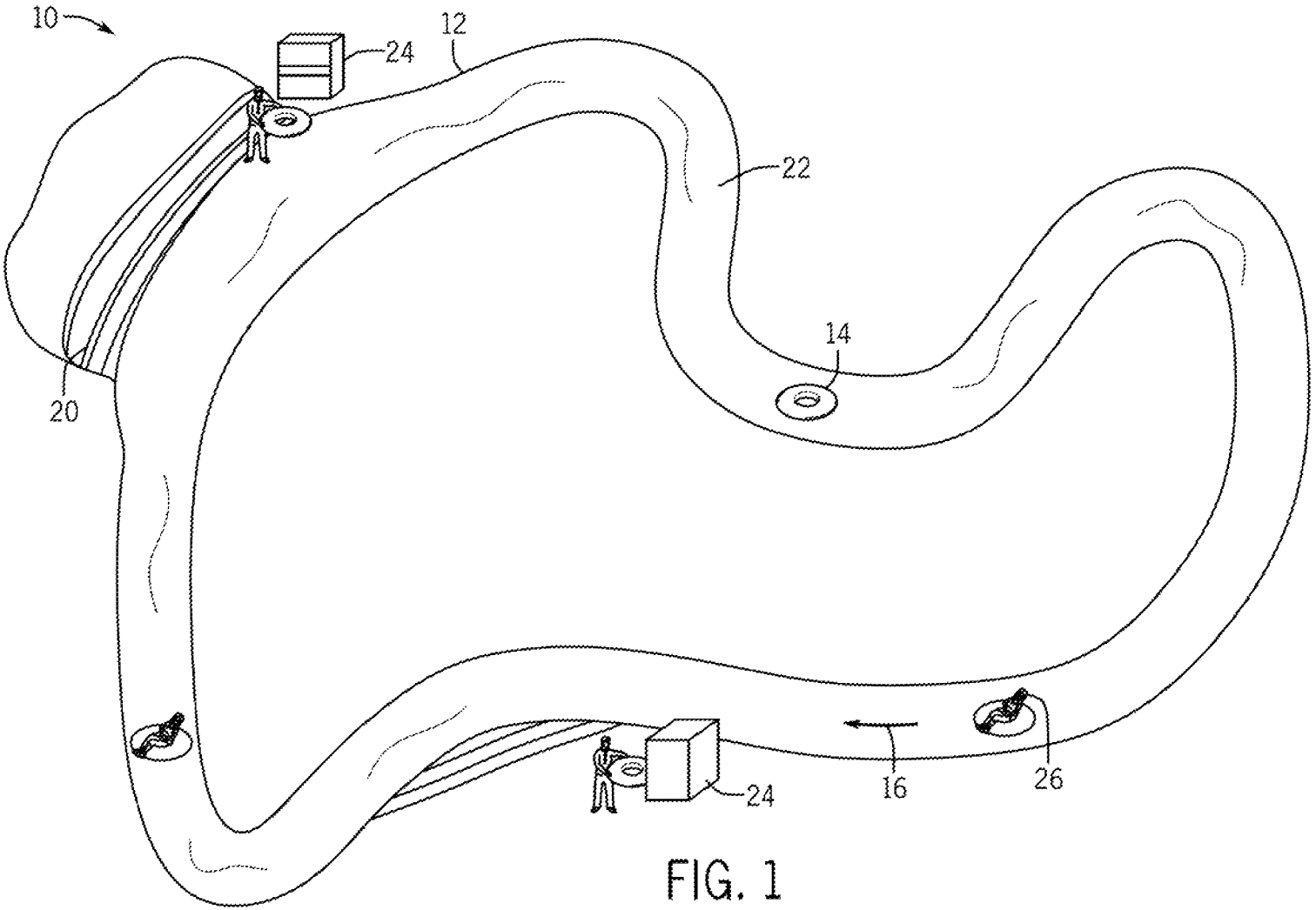
FIG. 1 is a perspective view of a lazy river ride including a flotation device dispenser in accordance with present techniques.

FIG. 1 is a perspective view of a lazy river ride 10 that includes a water circuit 12 for use with flotation devices 14. The flotation devices 14 may be configured as inner tubes for one or more passengers or, in other embodiments, may be rafts, boards, etc. The water circuit 12 flows in the direction of arrow 16 and has various passenger entry points 20 distributed about the water circuit 12. For example, each entry point 20 may include a dock or steps that lead into the water 22. As provided herein, a flotation device dispenser 24 may be positioned adjacent to one or more of the entry points 20. In this manner, a park guest who wishes to ride in the lazy river ride 10 as a passenger 26 can obtain a flotation device 14 from the dispenser 24 before entering the water circuit 12 via the entry point 20. Further, passengers exiting the ride 10 may load their flotation devices 14 back in the dispenser 24 for distribution to other passengers. In other embodiments, passengers may deposit used flotation devices 14 with a ride technician, who may then subsequently load the flotation devices 14 into the dispensers 24. The dispensers 24 may serve as collection and distributions centers for the flotation devices 14, creating a more orderly environment at each entry point 20.

Figure 2:
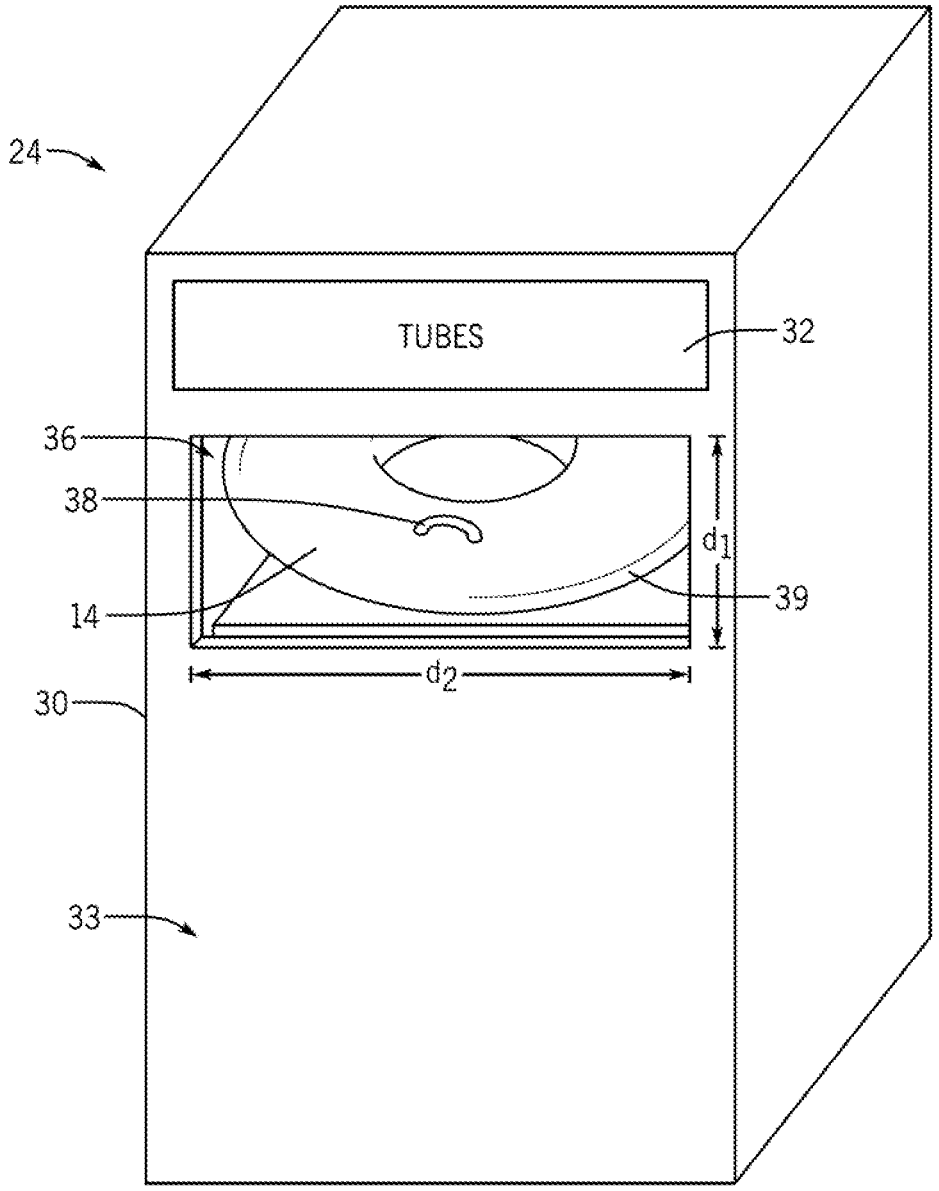
FIG. 2 is a perspective view of a flotation device dispenser in accordance with present techniques.

FIG. 2 is a perspective view of an example of the flotation device dispenser 24. The dispenser 24 includes a housing 30 that is sized and shaped to retain several flotation devices 14. In certain embodiments, the housing 30 may include text markings 32 or indications on an exterior surface 33 of the housing 30 to alert water ride passengers to the purpose of the dispenser 24. In one embodiment, the housing 30 may be configured to include ride theme-appropriate markings or features. For example, for a jungle-themed water ride, the housing 30 may be configured in the shape of a hippo or a rainforest tree. The housing 30 forms an aperture 36 open to the interior of the housing 30 and through which one or more flotation devices 14 may be accessed and removed by a water ride passenger. In certain embodiments, the flotation devices 14 may include handles 38 to facilitate removal. In the depicted embodiment, the dispenser 24 is arranged to dispense flotation devices 14 stacked together in a generally horizontal position (e.g., stacked so that their longest dimension is approximately parallel to a ground surface). Accordingly, the handles 38 may be arranged on a side wall 39 of the flotation devices, which is exposed in the aperture 36. In certain embodiments, the flotation device 14 may include a plurality of handles 38 distributed about the side wall 39 such that an individual handle 38 will be accessible via the aperture regardless of the rotational orientation of the flotation device 14. In other embodiments, the flotation devices 14 may be dispensed in a vertical or angled position.

In one embodiment, the housing 30 is implemented as a free-standing kiosk (e.g., positioned at a water circuit entry point 20, see FIG. 1), and the aperture 36 may be positioned on the housing 36 at a height accessible for an average passenger. In addition, the aperture 36 may be sized and shaped to accommodate removal of at least one flotation device 14. To that end, the height, indicated by $d_1$, and length, indicated by $d_2$, of the aperture 36 formed in the housing 30 may be selected based on the dimensions of the flotation device 14. In one embodiment, the height $d_1$ and the length $d_2$ may be selected to be at least as large as the corresponding dimensions of the flotation device 14 to facilitate removal of the flotation device 14. In another embodiment, one or both of the height $d_1$ and the length $d_2$ may be selected to be slightly smaller than their corresponding dimensions of the flotation device 14. In this manner, the flotation device 14 is retained within the aperture 36 by housing in a ready-to-dispense configuration, and the slightly smaller size of the aperture 36 prevents the flotation device 14 from slipping out before being dispensed. However, because the flotation device 14 may be formed from a compressible material, the passenger may compress the flotation device 14 to permit the flotation device 14 to pass through the slightly smaller aperture 36.

While the depicted embodiment shows the dispenser 24 configured to distribute a single flotation device 14 via the aperture 36, in other embodiments, two, three, or more flotation devices 14 may be dispensed at a time through the aperture 36. For example, the housing 30 and the aperture 36 may be sized and shaped to permit several flotation devices 14 to be arranged in side-by-side stacks, whereby the top flotation device 14 in each adjacent stack is accessible via the aperture 36. For example the length dimension $d_2$ may be relatively longer (e.g., 2-3 times as long) while the height dimension $d_1$ may be unchanged relative to an embodiment sized to dispense a single flotation device 14. In another embodiment, the aperture 36 may be sized and shaped to permit several flotation devices 14 stacked top-to-bottom to be removed at a time. For example the height dimension $d_1$ may be relatively longer (e.g., 2-3 times as long) while the length dimension $d_2$ may be unchanged relative to an embodiment sized to dispense a single flotation device 14. In such embodiments, the dispenser 24 may service several passengers in parallel, which may result in increased throughput into the ride.

Figure 3:
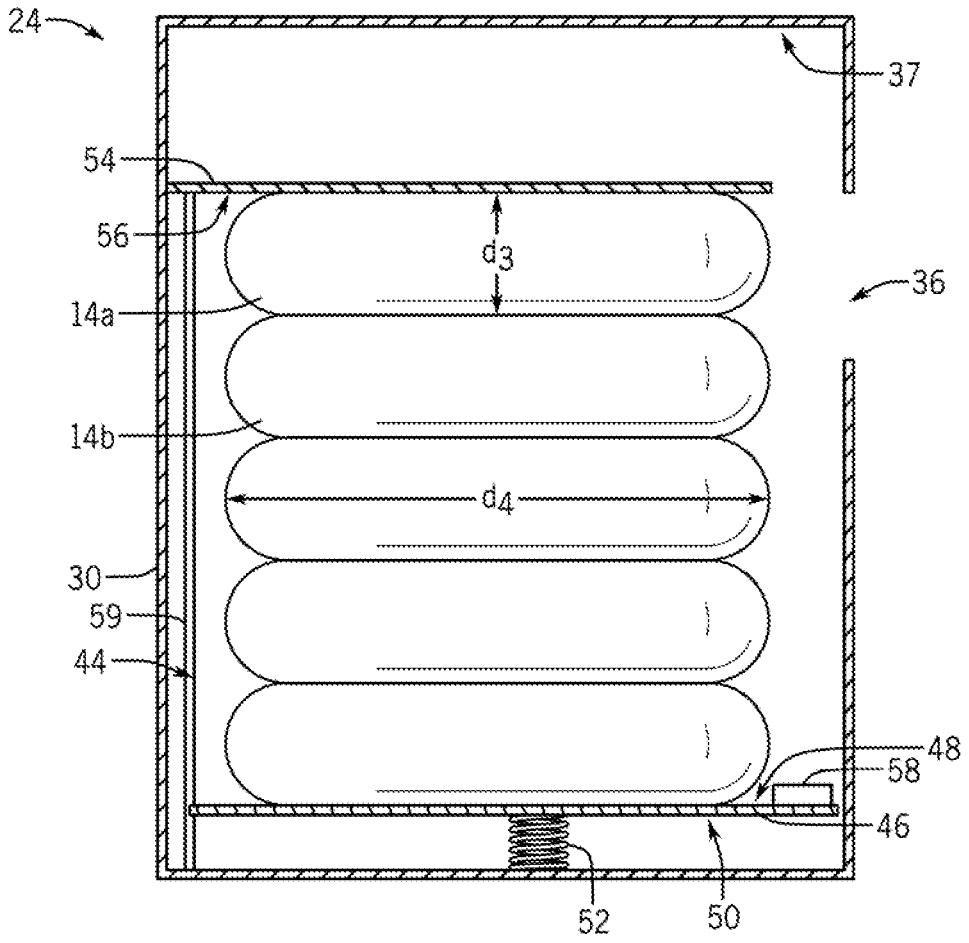
FIG. 3 is a cross-sectional view of the flotation device dispenser of FIG. 2.

FIG. 3 is a cross-sectional view of the dispenser 24 of FIG. 2 showing the interior space 44 of the housing 30. The interior space 44 and the aperture are configured to accommodate the height $d_3$ and diameter $d_4$ (or other dimension, depending in the configuration) of the flotation devices 14. The aperture 36 permits access to the interior space 44, within which a plurality of flotation devices 14 is retained. The flotation devices 14 are supported by a base member 46, which has a supporting surface 48 in contact with a flotation device 14 and an opposing surface 50 coupled to a spring 52. When the dispenser 24 is full, as in the depicted embodiment, the spring 52 is compressed, and the base member 46 exerts pressure on the stack of flotation devices 14 in the direction of the aperture 36 and an abutment member 54. In certain embodiments, the abutment member 54 is positioned at or within the aperture 36 such that the topmost flotation device **14*a* in the stack abuts a surface 56 of the abutment member and is positioned at the aperture 36 for removal. When the flotation device 14*a* is removed, the flotation device 14*b* is then positioned in the aperture 36 via extension of the spring 52, which in turn moves the base member 46 and the remaining flotation devices 14 towards the aperture 36. While the depicted embodiment is illustrated with a spring 52, it should be understood that the base member 46** may be actuated with a hydraulic device, a motor, buoyancy, a gas spring, etc.

When all of the flotation devices 14 are removed and the dispenser 24 is empty, the base member 46 may be configured to be positioned within the aperture 36. In one embodiment, the spring 52 is selected such that a maximum extension of the spring positions the base member 46 spaced apart from, i.e., not in contact with, the abutment member 54. In another embodiment, when the dispenser 24 is empty, the base member 46 is pushed against the surface 56 of the abutment member 54. In certain embodiments, the abutment member 54 stops the base member 46 from being moved against the top 57 of the dispenser. For example, the abutment member 54 may be configured to only partially overlap with the base member 46, leaving an overhang 58 of the base member 46 relative to the abutment member 54, which may prevent a passenger's fingers from being pinched between the base member 46 and the abutment member 54 during removal of the last flotation device 14. The overhang 58 may also serve as a handle to facilitate a technician or passenger grabbing the base member 46 to reload the dispenser 24 by compressing the spring 52. In other embodiments, the dispenser 24 may also be implemented without an abutment member 54. For example, in a top-loading dispenser, the base member 46 may be permitted to extend towards a top or cover of the dispenser 24. In one embodiment, to prevent tilting of the base member 46 relative to the housing 30, which may occur during manual loading, the housing 30 may also include one or more interior rails 59. The base member 46 may be configured to slide or move along the interior rail 59 as the base member 46 moves within the housing 30.

Figure 5:
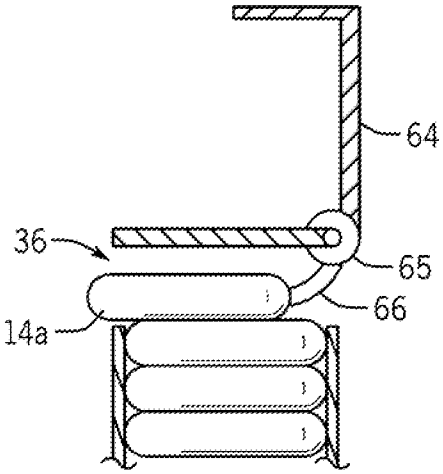
FIG. 5 is a detail view of the horizontal ejector of FIG. 4.
Figure 4:
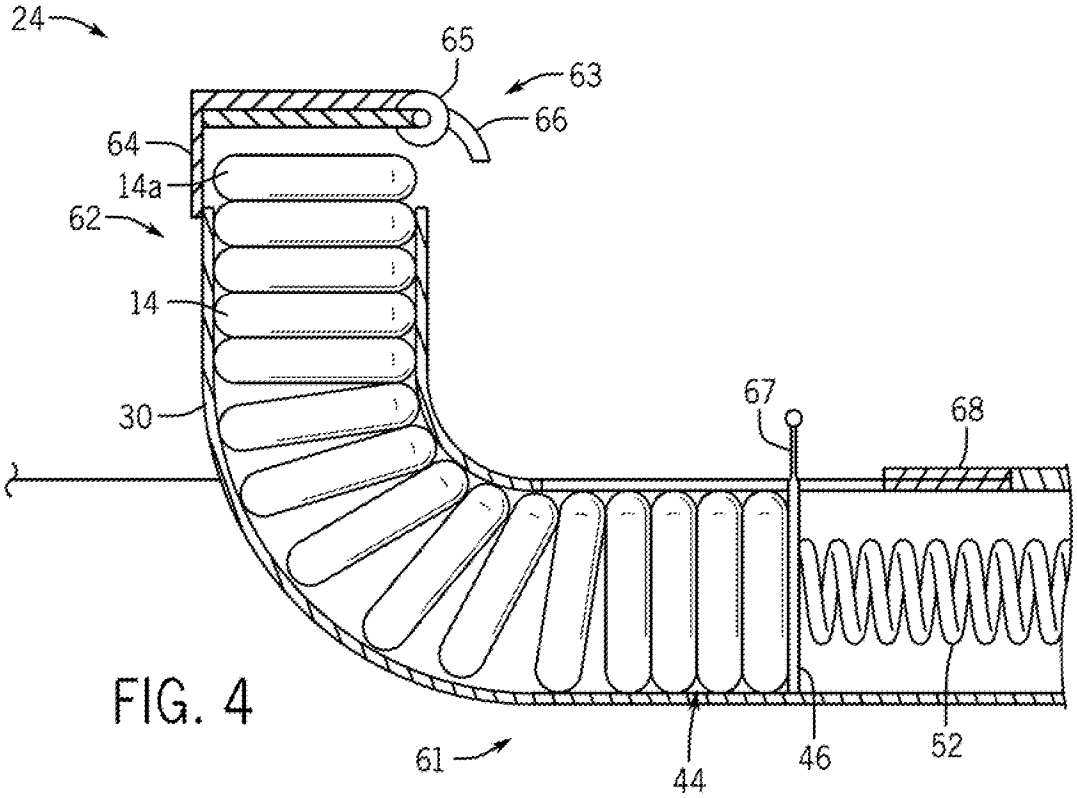
FIG. 4 is a cross-sectional view of a flotation device dispenser including a horizontal ejector in accordance with present techniques.

The dispensers 24 as disclosed herein may be positioned in or near the water. In another embodiment, the dispenser 24 may be at least partially within the ground, as shown in FIG. 4. The dispenser 24 includes a below-ground portion 61 and an above-ground portion 62. Such an arrangement permits loading and storage of more flotation devices 14 without affecting the footprint of the water park. The dispenser 24 as provided herein may also include a horizontal ejector 63 that pushes the uppermost flotation device out of the housing. The depicted embodiment is in the closed configuration, with a door 64 of the dispenser closing the aperture 36. When the door is opened, as shown in FIG. 5, the door 64 pivots about the coupler 65, which in turn pushes the horizontal actuator 66 towards the flotation device 14*a* to at least partially push the flotation device 14*a* out of the aperture 36 for retrieval by a passenger.

Turning back to FIG. 4, the underground portion 61 may also permit ground-level loading. For example, a passenger or technician may actuate a handle 67 coupled to the base member 46 to increase tension in the spring 52 and create space for loading addition flotation devices. A cover 68 (e.g., a telescoping cover or a door) may prevent access to the interior space 44.

Figure 6:
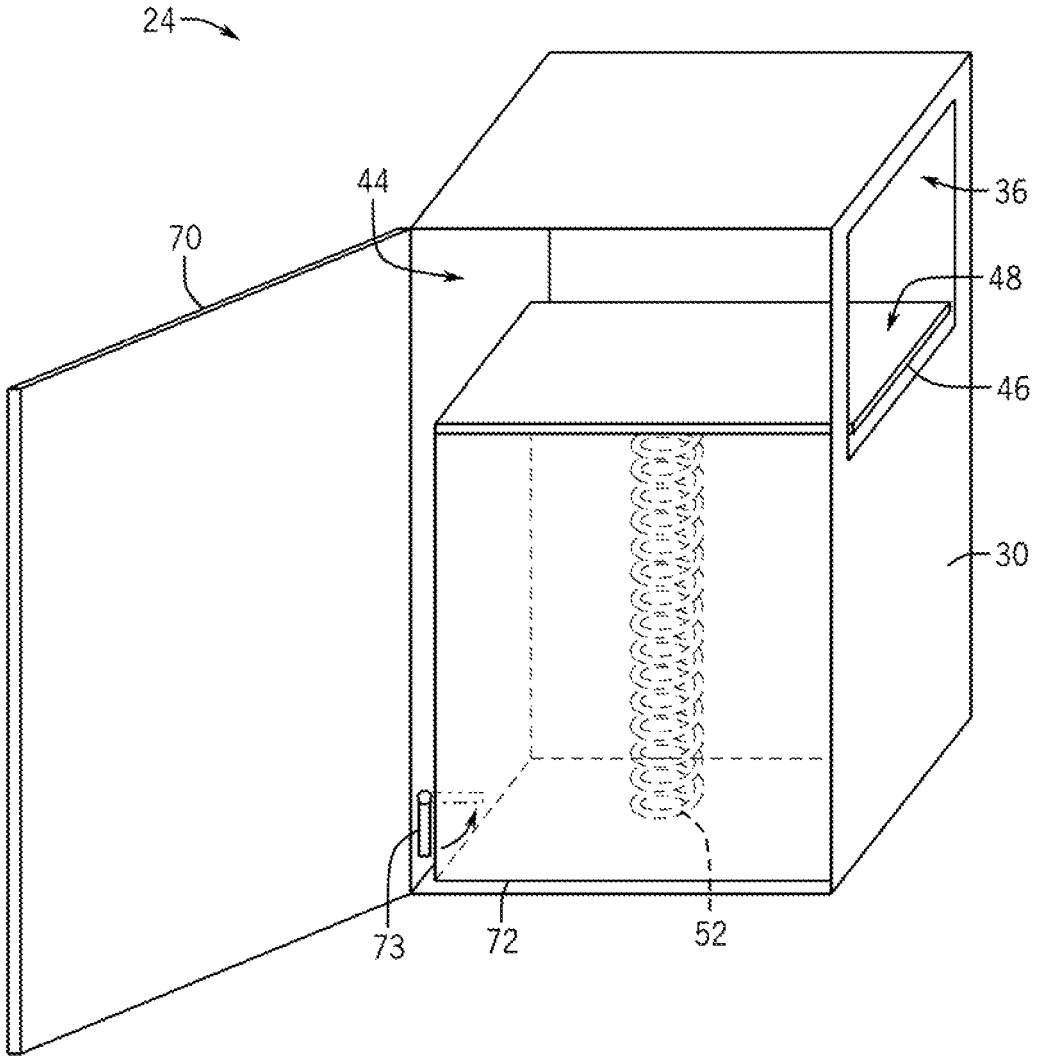
FIG. 6 is a perspective view of a flotation device dispenser including a loading or service door in accordance with present techniques.

In certain embodiments the dispenser 24 may be reloaded by a passenger or ride technician. As illustrated in FIG. 6, the interior space of the dispenser 24 may accessed by a door 70 hingedly coupled to the housing 30. Upon determining that the dispenser 24 is empty, for example because the supporting surface 48 of the base member 46 is exposed, the technician may access the interior space 44 and load the flotation devices 14. In the depicted embodiment, the base member 46 is coupled to a telescoping or flexible cover 72 that moves in conjunction with the base member 46 and that prevents access to the spring 52, e.g., to protect the flotation devices 14 from being pinched or punctured by the spring 52 during loading. The dispenser 24 may also include a spring lock 73, such as a pivotable pin that, when engaged in the locked position, prevents upward movement of the base member 46 to hold the spring 52 in a compressed configuration after the base member 46 has been pushed down for loading. The spring 52 may be selected to be compressed into the loading position with a force that is capable of being applied manually.

Figure 7:
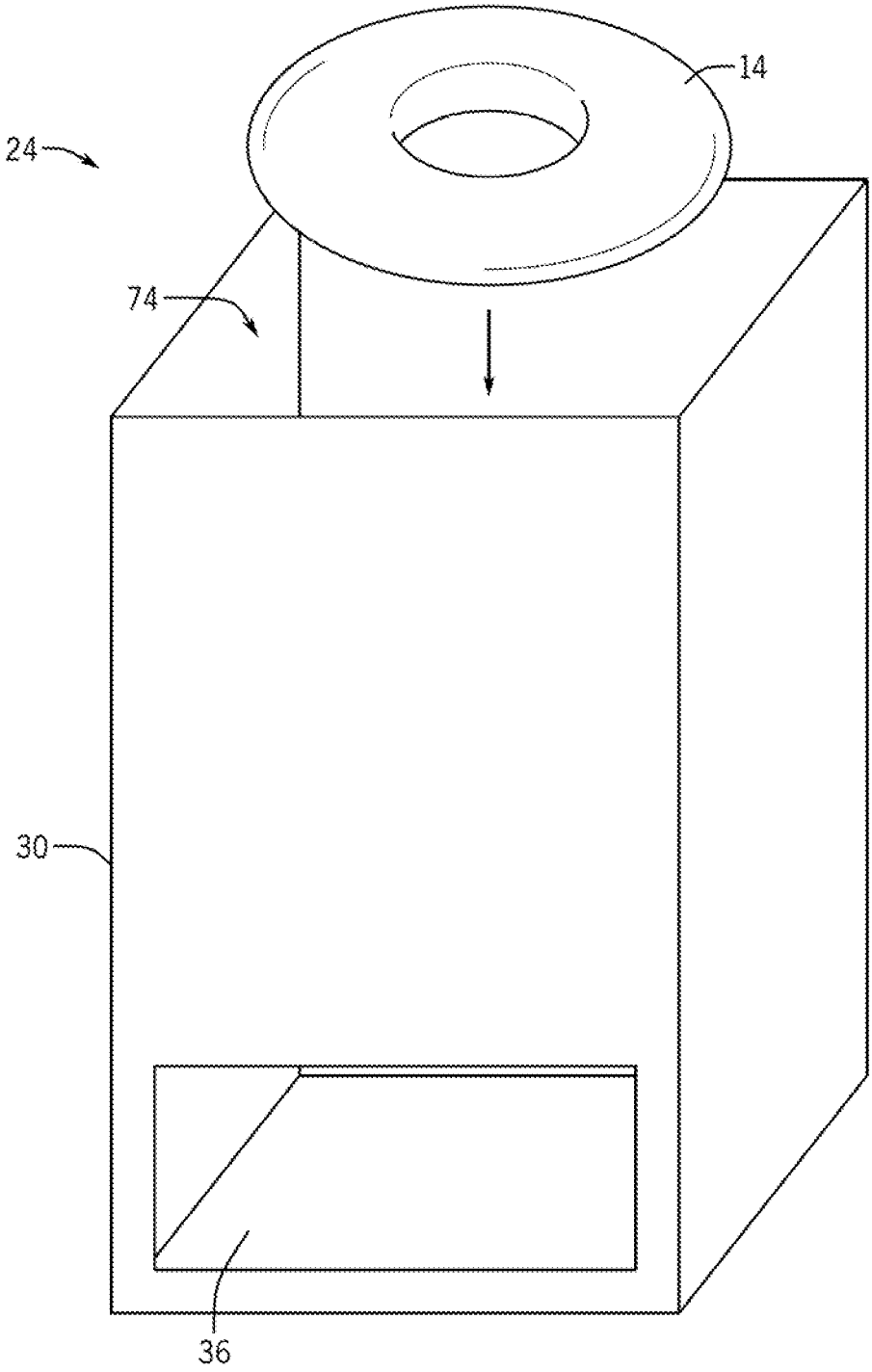
FIG. 7 is a perspective view of a top-loading flotation device dispenser in accordance with present techniques.

In another embodiment, the dispenser 24 may be implemented without a spring or internal biasing mechanism. For example, the dispenser 24 illustrated in FIG. 7 dispenses through a bottom aperture 36 that is lower than a loading passage 74. Each successive flotation device 14 is pushed down towards the aperture 36 when the bottom flotation device 14 is dispensed. Accordingly, the dispenser 24 may rely on gravity instead of or in addition to spring or other biasing forces. In one embodiment, the housing 30 of the dispenser 24 may be angled, e.g., in a tunnel or chute configuration to permit top-loading via the loading passage 70 even for relatively shorter passengers.

Figure 8:
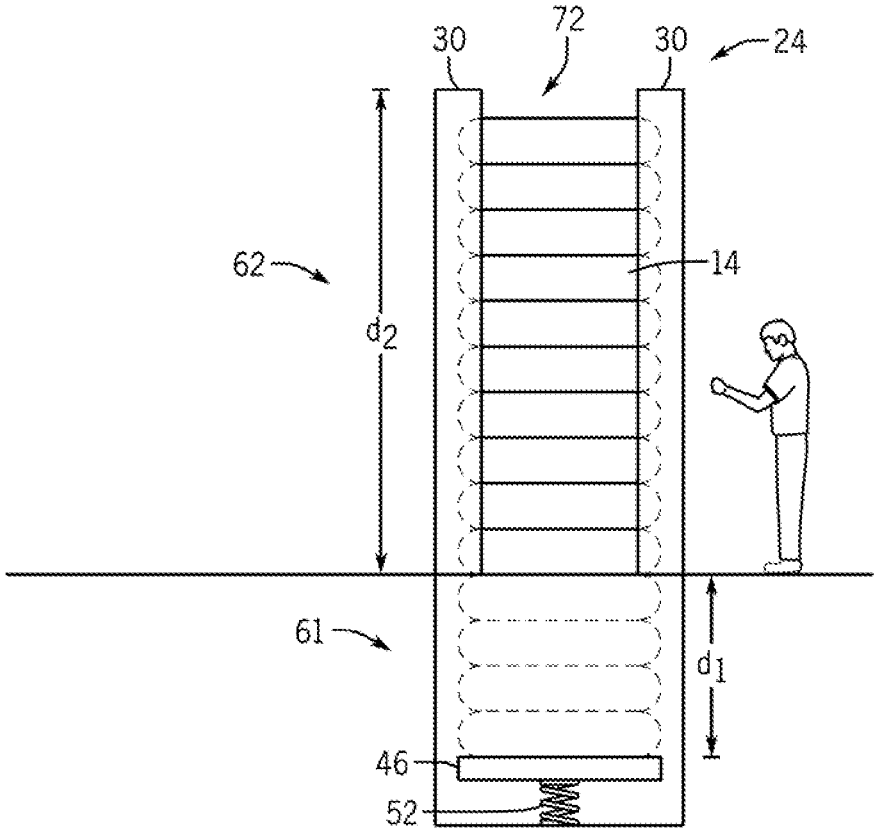
FIG. 8 is a side view of a top-loading flotation device dispenser including a below ground portion in accordance with present techniques.

FIG. 8 is an alternate embodiment of a dispenser 24 including an underground portion. In the illustrated embodiment, the dispenser 24 may have an underground portion 61 and an above-ground portion 62. The housing 30 may be formed by two or more spaced apart posts (e.g., two, three, four, or more posts), such that an entire side of the dispenser is open to form an aperture, which may be smaller than the flotation devices in at least one dimension (e.g., a width dimension) to retain the flotation devices 14 in place. In this manner, the guest may pull out any conveniently located flotation device 14 along the entire side of the dispenser 24 without being limited by the height of the aperture, which may be convenient for guests of different heights. Further, the housing 30 may have open side walls on multiple sides, permitting access to the flotation devices 14 at multiple sides of the dispenser 24. In one embodiment, the housing 30 is formed by posts positioned at the four corners of the housing 30, forming corresponding open side wall apertures. The dispenser 24 may be gravity loaded via the top 72, with a spring 52 pushing the base member 46 towards the top 72 as each individual flotation device 14 is removed. The below ground distance $d_1$ and the above ground distance $d_2$ may be selected to allow the desired capacity and size of the dispenser 24.

As provided herein in any of the disclosed embodiments, the spring 52 may have a spring force calibrated to allow the base member 46 to move up approximately the height of one flotation device 14 after one flotation device 14 is removed from the dispenser. The spring force may be determined by the material and the number of coils of the spring 52 and may define a distance that the base member moves 46.

Figure 9:
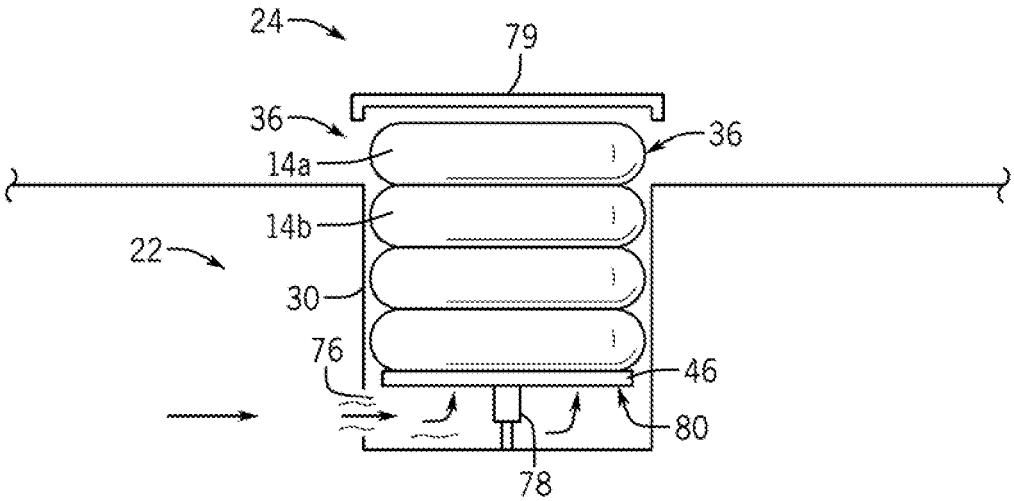
FIG. 9 is a cross-sectional view of a partially submerged flotation device dispenser in accordance with present techniques.

The dispensers 24 as provided herein may be configured to be implemented on the shore of the lazy river, i.e., out of the water. In another embodiment, the dispensers 24 may be implemented to be at least partially within the water 22, as shown in FIG. 9. Further, while submerged or partially submerged dispensers 24 may be configured to dispense flotation devices 14 using buoyancy (e.g., by loading in the water and allowing the flotation devise 14 to float to the aperture 36) and/or spring forces, the dispenser 24 may also use the current flow of the water 22 to aid in dispensing the flotation devices 14. For example, in one embodiment, the housing 30 of the dispenser 24 is positioned at least partially within the water 22 such that a flow port 76 is open to the water 22. The current of the lazy river ride 10 (see FIG. 1) pushes the water 22 through the flow port 76 and into contact with the base member 46. The flow port 76 is positioned to be located below the base member 46 or closer to the opposing surface 50. The water 22 exerts upward pressure on the base member 46 to push the flotation devices towards the aperture 36. In the depicted embodiment, the aperture 36 may be implemented on multiple sides of the housing 30, permitting multidirectional dispensing of the flotation devices 14. The base member 46 may be coupled to the housing 30 via a telescoping rod 78 that permits the base member 46 to move relative to the housing 30 as a result of water pressure. When a topmost flotation device 14*a* is removed from the dispenser 24 via the aperture 36, the next successive flotation device 14*b* is pushed against the top or cover 79 of the dispenser 24 by the base member 46, which pushes all of the flotation devices 14 jointly. The position of the cover 79 may be at a comfortable chest height for a passenger standing in the water 22. In certain embodiments, the cover 79 may protrude from the water 22 by a preset distance to facilitate easy viewing and access.

Figure 10:
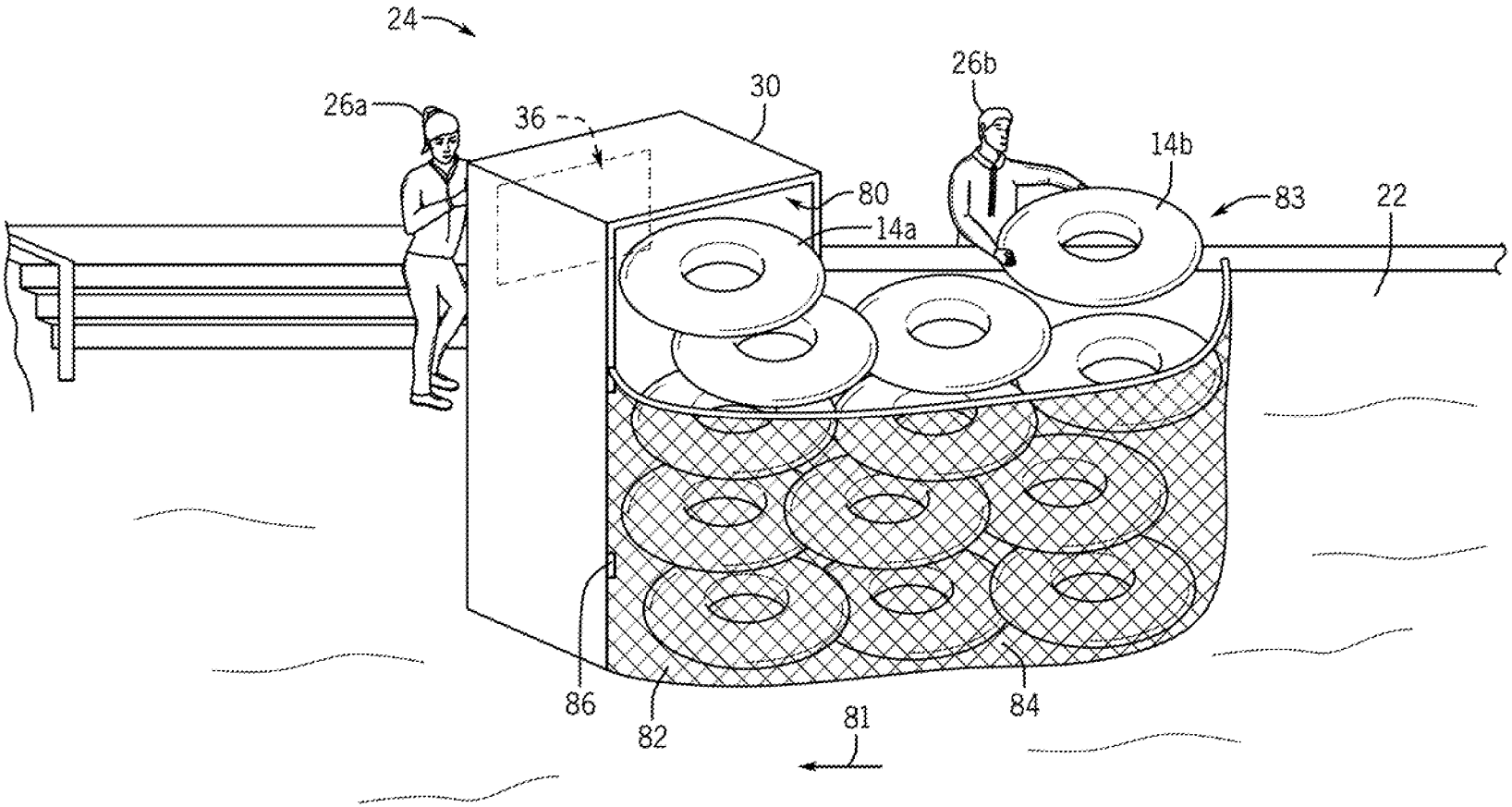
FIG. 10 is a perspective view of a partially submerged flotation device dispenser including a retention device in accordance with present techniques.

In another embodiment, as shown in FIG. 10, a partially submerged dispenser 24 may permit substantially concurrent loading and retrieval of flotation devices 14 with relatively little technician intervention. For example, the housing 30 may be configured to have an open back 80, i.e., open to water flow in the direction of the current, shown by arrow 81, that is coupled to a retention member 82, such as a net, defining a retention area 83 configured to collect used flotation devices 14 and prevent drifting of the collected flotation device 14 in the water 22. In one embodiment, the retention member 80 may permit water flow in the direction of the current through holes 84 or pores. In this manner, the water 22 flows within the retention area 83 and towards the aperture 36, pushing the flotation devices 14 towards the aperture for dispensing. The retention member 82 may be relatively conformable such that the size of the retention area 83 changes as the current pushes the retention member 82. Further, the retention member 82 may be formed from an elastic material and biased towards the aperture 36. In this manner, the retention member 82 may be expanded to create a larger retention area 83 and may further create additional biasing, along with the current of the water flow, towards the aperture 36. In another embodiment, the retention member 82 may be relatively rigid, permitting water flow-through, but defining a relatively fixed retention area 83. An entering passenger 26*a* may retrieve the flotation device 14*a* through the aperture while the exiting passenger 26*b* deposits the used flotation device 14*b* in the retention area 83. Because the retrieval and deposit areas of the illustrated dispenser 24 are spaced apart from each other, the passengers 26 may load and unload in parallel, which may improve ride throughput and entry bottlenecks. The retention member 82 may be removable, via couplers 86 (e.g., hooks, straps, fasteners), from the housing 80. For example, if the retention member 82 is a net with a closed bottom surface, the entire retention member 82 and any enclosed flotation devices 14 may be removed jointly at the close of the ride to permit cleaning and/or service.

Figure 11:
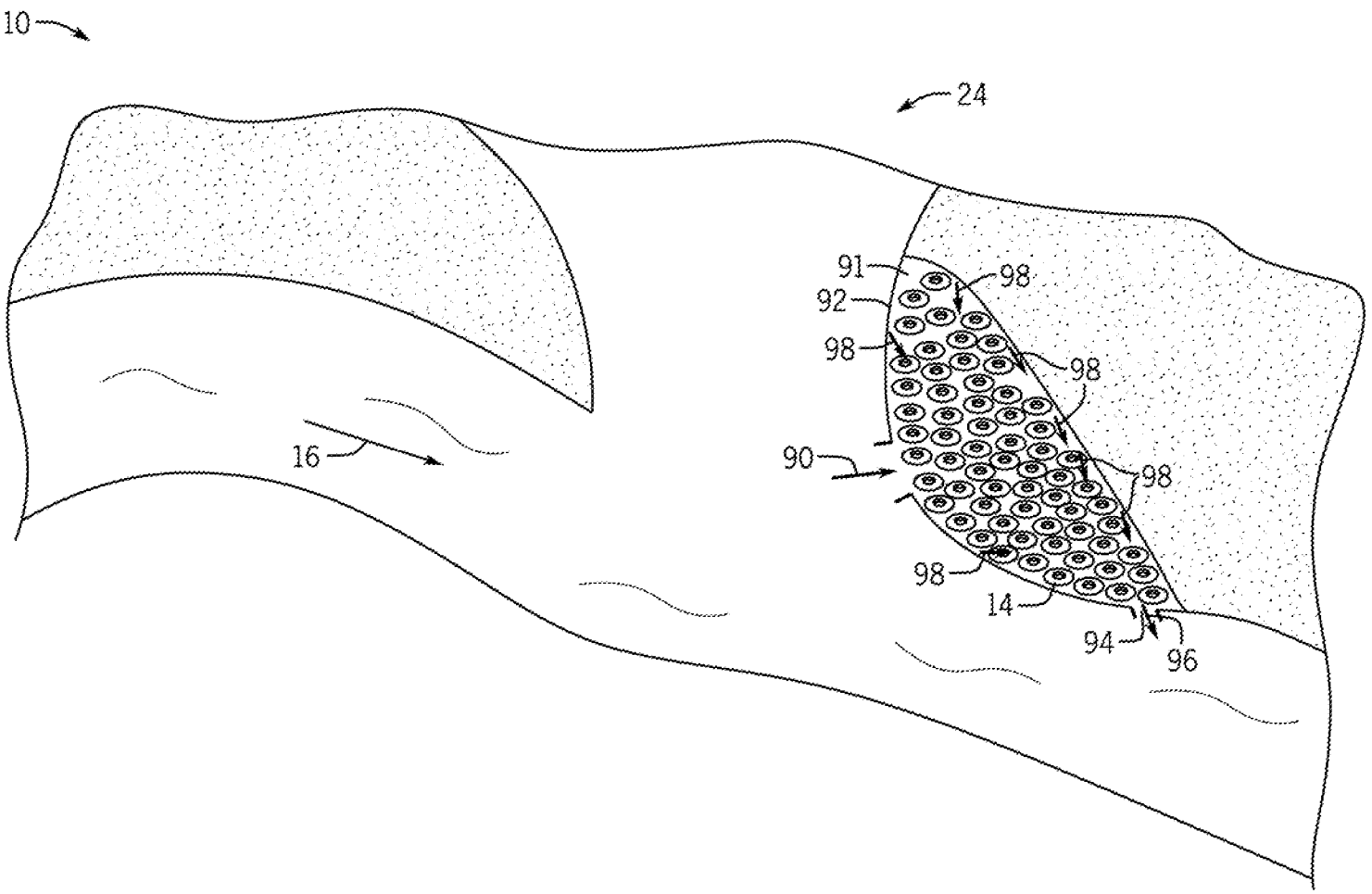
FIG. 11 is a top view of a partially submerged current or flow-driven flotation device dispenser including a retention device in accordance with present techniques.

FIG. 11 is a schematic illustration of a water ride 10 including a current-driven dispenser 24 for flotation devices 14 that may be implemented adjacent to a water entry area, e.g., a zero depth entry area. Such a dispenser 24 may be implemented without a moving platform or other fixed housing member. Instead, the current 16 pushes any free flotation devices 14 through a tube entry 90 and into a containment area 91 defined by walls 92 or other restraining elements (e.g., a net, ropes, etc.). The flotation devices 14 are thus captured by the dispenser 24 to allow the ride 10 to remain clear of unused flotation device 14. The dispenser also includes a tube exit 94 that allows the flotation devices 14 to exit in the direction of arrow 96 to be used by guests entering the ride 10. The flotation devices 14 may be pushed via water jets 98 that are configured such that the jet flow pushes the flotation device 14 away from the tube entry 90 and towards the tube exit 94. The tube exit may 94 be formed to be smaller than the flotation device 14 in at least one dimension to maintain the flotation devices 14 within the containment area clustered against the tube exit 94 and such that removal of the flotation device 14 requires a pulling force applied by the guests (e.g., a pulling force that compresses the flotation device 14 to permit exit via the tube exit 94). In this manner, the tube exit 94 has a steady flow of flotation devices 14 queued and ready to be dispensed and that are not able to exit back into the ride 10 without guest intervention.

Figure 12:
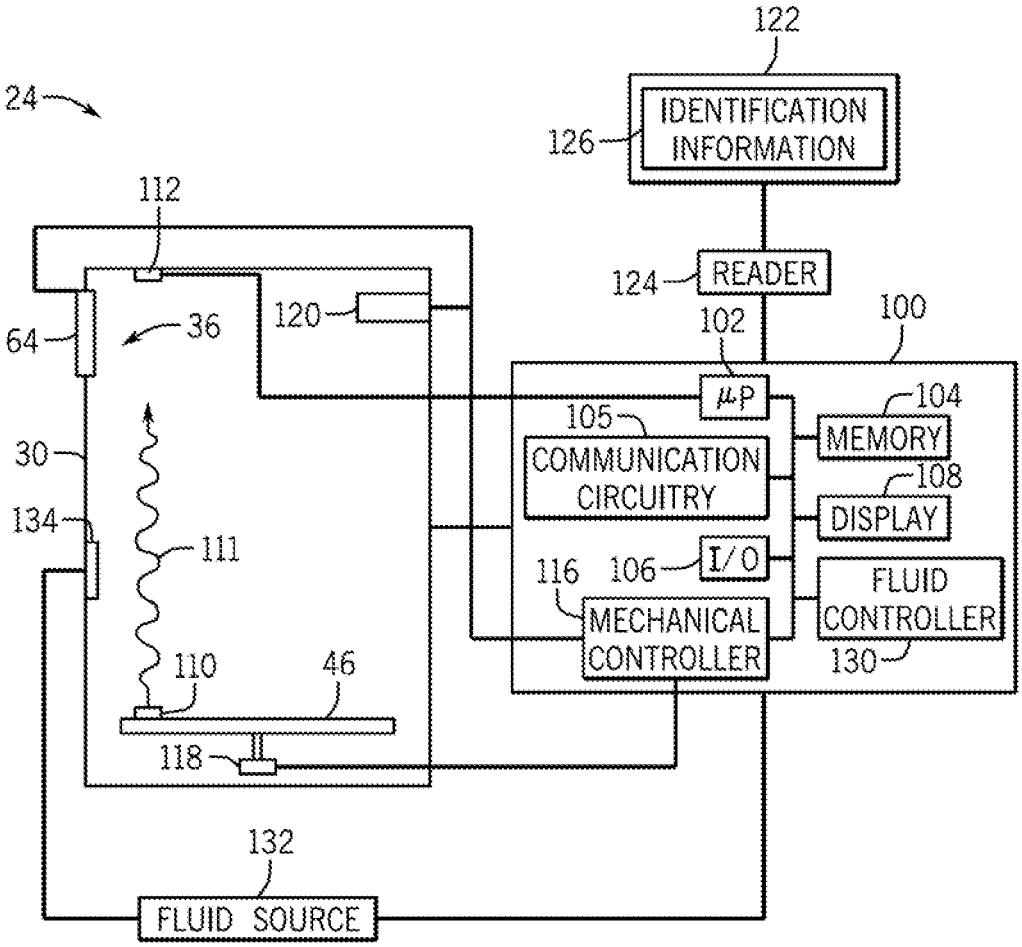
FIG. 12 is a block diagram of a flotation device dispenser including a controller in accordance with present techniques.

In certain embodiments, various features of the dispenser 24 may operate under a control system 100, as shown in the block diagram of FIG. 12. The control system 100 may include a processor 102, which may include one or more processing devices, and a memory 104 storing instructions executable by the processor 102. The memory 104 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 102 or by any general purpose or special purpose computer or other machine with a processor. The control system 100 may also include communications circuitry 105 and/or input and output circuitry 106 to facilitate communication with other components of the dispenser 24 and/or with water park management systems. Further, the controller 100 may include a display 108 that provides information about status of the dispenser 24 to ride technicians or passengers.

In one embodiment, the display 108 provides an EMPTY or RELOAD message in response to input from a sensor coupled to the housing 30 that indicates that all of the flotation devices have been removed from the dispenser 24. For example, such a sensing system may include a light emitter 110 that emits light (shown by arrow 111) under control of the controller 100 in the direction of a detector 112. Based on the amount of light detected, the control system 100 may determine if the dispenser 24 is empty. Other types of sensing systems may also be employed to assess the status of the dispenser 24, such as proximity sensors or position sensors coupled to the base member 46. In addition to providing a message on the display 108, an empty status may also be communicated to a park management system so that reloading can be scheduled.

The control system 100 may also control movement of the base member 46 via a mechanical controller 116 coupled to a motor 118 that drives the base member 46 to move up or down within the housing 30. In addition, the mechanical controller 116 (which may, in certain embodiments, be implemented separately from the base member motor controller) may control the opening and closing of a door 64 covering the aperture 36. For example, the mechanical controller 116 may also control a motor coupled to the door 64 and that moves the door 64 from a closed position to an open position. The mechanical controller 116 may also control a horizontal ejector 63. In one embodiment, the control system 100 may receive input from a guest, e.g., via a body-worn device 122 (bracelet, tag, etc.), that is swiped through a reader 124, which in turn passes identification information 126 for the guest to the control system. If the input indicates that the guest has permission to access the water ride, the mechanical controller 116 opens the door 64 to permit access to the flotation devices. If the guest does not have permission to access the water ride, the door 64 remains in the default closed position.

The control system 100 may also control a fluid delivery controller 130 that activates delivery of cleaning fluid to the dispenser 24 to clean the flotation devices. The fluid delivery controller 130 is coupled to one or more fluid sources 132 containing cleaning fluid (e.g., water, disinfectant) in fluid communication with one or more fluid inlet ports 134. In another embodiment, the flotation devices may be exposed to UV light, and the dispenser 24 may include a UV light source under control of the control system 100. Upon receiving a signal from the control system 100, the fluid delivery controller 130 may open the flow of fluid within the dispenser 24, e.g., by opening a valve to release the fluid. Accordingly, the fluid delivery controller 130 may be coupled to suitable flow control elements. In one embodiment, the control system 100 places the dispenser 24 in cleaning mode during fluid flow, and the door 64 remains closed, even in response to a valid guest input requesting access to a flotation device. When cleaning is finished, the dispenser 24 is taken out of cleaning mode to permit normal guest access to the flotation devices. The cleaning mode may be activated on a preset schedule or in response to operator input. In certain embodiments, the cleaning mode may be permitted only when the dispenser 24 is full. For example, a ride technician may load the dispenser 24 with flotation devices gathered as passengers exit the water ride and then may activate the cleaning mode to prepare the flotation devices for dispensing and reuse.

While only certain features of the present disclosure have been illustrated and described herein, many modifications and changes will occur to those skilled in the art. Further, it should be understood that components of various embodiments disclosed herein may be combined or exchanged with one another. It is, therefore, to be understood that the appended claims are intended to cover all such modifications and changes as fall within the true spirit of the disclosure.

The invention claimed is:

1. A dispenser for a flotation device, comprising:

a housing comprising an aperture;

a plurality of flotation devices positioned in the housing; and a base positioned in the housing and supporting the plurality of flotation devices, wherein the base is configured to move relative to the housing to move the plurality of flotation devices jointly to position at least one flotation device adjacent to the aperture to permit removal of the at least one flotation device from the housing via the aperture wherein the aperture is configured to be in a default closed position, and wherein the dispenser comprises a mechanical controller configured to receive an input from a reader and open the aperture in response to the input.

2. The dispenser of claim 1, comprising an actuator or biasing member coupled to the base and configured to move the base towards the aperture.

3. The dispenser of claim 2, wherein the base comprises a supporting surface in contact with only one of the flotation devices of the plurality of flotation devices and an opposing surface coupled to the biasing member.

4. The dispenser of claim 2, wherein the biasing member comprises a spring.

5. The dispenser of claim 4, wherein the spring, when fully uncompressed and when the plurality of flotation devices have been removed from the housing, is configured to position the base adjacent to or within the aperture.

6. The dispenser of claim 1, wherein the aperture is between two or more posts of the housing.

7. The dispenser of claim 1, comprising a loading opening or door formed in the housing and configured to permit loading of the plurality of flotation devices.

8. The dispenser of claim 1, wherein each of the plurality of flotation devices comprise one or more handles positioned on a side wall of each respective flotation device.

9. The dispenser of claim 1, comprising a fluid port formed in the housing and configured to deliver a fluid within the housing to the plurality of flotation devices.

10. The dispenser of claim 1, wherein the plurality of flotation devices comprise inner tubes.

11. The dispenser of claim 1, wherein the aperture remains in the default closed position if the input comprises guest identification information from a body-worn device and wherein the guest identification information is associated with a water ride restriction.

12. The dispenser of claim 1, wherein the controller is configured to provide an indication when the dispenser is ready to be reloaded with a second plurality of flotation devices.

13. The dispenser of claim 1, wherein the aperture remains in the default closed position that overrides the input if the dispenser is in a cleaning mode, wherein the cleaning mode comprises application of cleaning fluid to the plurality of flotation devices.

14. The dispenser of claim 1, comprising a horizontal ejector configured to push a flotation device at least partially through the aperture.

15. The dispenser of claim 14, comprising a door closing the aperture, and wherein the horizontal ejector is coupled to the door such that opening the door causes the horizontal ejector to move towards the aperture to push the flotation device.

16. A water park attraction, comprising:

a water circuit; and an inner tube dispenser for inner tubes configured to be used in the water circuit, wherein the inner tube dispenser comprises:

a housing comprising an aperture;

a plurality of inner tubes; and a moveable portion coupled to the housing and supporting the plurality of inner tubes, wherein the movable portion is configured to move relative to the housing to move the plurality of inner tubes to position at least one inner tube adjacent to the aperture to permit removal of the at least one inner tube from the housing via the aperture wherein the housing comprises one or more openings positioned within the water circuit and the movable portion is positioned in the water circuit and wherein the water circuit flows through the one or more openings towards the aperture to move the movable portion relative to the housing.

17. The water park attraction of claim 16, wherein the movable portion comprises a flexible material comprising a plurality of openings that permit flow of water in the water circuit through the housing.

18. The water park attraction of claim 16, wherein the movable portion comprises an elastic material biased towards the aperture.

19. The water park attraction of claim 16, wherein the housing is open at a location opposing the aperture to form the one or more openings.

20. The water park attraction of claim 16, wherein the movable portion comprises a platform having an inner tube supporting surface and an opposing surface, wherein the opposing surface contacts the water circuit to permit water flow to move the platform towards the aperture.

21. The water park attraction of claim 16, wherein the housing comprises an opening to permit loading of the inner tubes, and wherein the aperture is positioned in or closer to the water circuit than the opening.

22. A water park attraction, comprising:

a water circuit having a flow direction; and an inner tube dispenser for inner tubes configured to be used in the water circuit, wherein the inner tube dispenser comprises:

a containment area comprising an entry aperture and an exit aperture;

a plurality of inner tubes; and a plurality of flow ports within the containment area configured to create additional movement of the inner tubes towards the exit aperture, wherein the entry aperture is larger than the exit aperture, and wherein the exit aperture is smaller than at least one dimension of one of the plurality of inner tubes.

* * * * *